US011234574B2

(12) United States Patent
Wu et al.

(10) Patent No.: US 11,234,574 B2
(45) Date of Patent: Feb. 1, 2022

(54) INTELLIGENT FLOOR CLEANING ROBOT

(71) Applicant: Zhejiang Guozi Robot Technology Co., Ltd., Hangzhou (CN)

(72) Inventors: Weifeng Wu, Hangzhou (CN); Huafeng Yang, Hangzhou (CN); Lvjun Jin, Hangzhou (CN); Jiang Hong, Hangzhou (CN)

(73) Assignee: Zhejiang Guozi Robot Technology Co., Ltd., Hangzhou (CN)

( * ) Notice: Subject to any disclaimer, the term of this patent is extended or adjusted under 35 U.S.C. 154(b) by 481 days.

(21) Appl. No.: 15/745,631

(22) PCT Filed: Jan. 12, 2018

(86) PCT No.: PCT/CN2018/072487
§ 371 (c)(1),
(2) Date: Jan. 17, 2018

(87) PCT Pub. No.: WO2019/136719
PCT Pub. Date: Jul. 18, 2019

(65) Prior Publication Data

US 2020/0297178 A1 Sep. 24, 2020

(51) Int. Cl.
*A47L 11/40* (2006.01)
*A47L 11/28* (2006.01)

(52) U.S. Cl.
CPC ..... *A47L 11/4061* (2013.01); *A47L 11/28* (2013.01); *A47L 11/4011* (2013.01);
(Continued)

(58) Field of Classification Search
None
See application file for complete search history.

(56) References Cited

U.S. PATENT DOCUMENTS

2011/0132402 A1* 6/2011 Ickes, III ..... B62D 1/105 134/18
2018/0120116 A1* 5/2018 Rombouts ..... G01C 21/32

FOREIGN PATENT DOCUMENTS

CN 103085858 A 5/2013
CN 203519559 U 4/2014
(Continued)

OTHER PUBLICATIONS

International Search Report with Written Opinion for PCT/CN2018/072487 dated Sep. 28, 2018, pp. 1-4.
(Continued)

*Primary Examiner* — Mikhail Kornakov
*Assistant Examiner* — Pradhuman Parihar
(74) *Attorney, Agent, or Firm* — McDonnell Boehnen Hulbert & Berghoff LLP

(57) ABSTRACT

An intelligent floor cleaner, including a vehicle body, a clean water tank, a control box, a dirty water tank, a floor cleaning apparatus, a manual steering apparatus, an autonomous steering apparatus, a navigation apparatus, and a mileage apparatus, where the clean water tank is located above the vehicle body and is fixedly connected to the vehicle body; the control box is located in a middle location above the vehicle body and is fixedly connected to the vehicle body; the dirty water tank is located at a rear side above the clean water tank and is fixedly connected to the clean water tank; the floor cleaning apparatus is located below the vehicle body; and the navigation apparatus includes a 3D laser and a laser mounting rack, and the navigation apparatus is located above the vehicle body.

10 Claims, 4 Drawing Sheets

(52) U.S. Cl.
CPC ..... *A47L 11/4069* (2013.01); *A47L 11/4072* (2013.01); *A47L 2201/04* (2013.01); *G05D 2201/0203* (2013.01)

(56) References Cited

FOREIGN PATENT DOCUMENTS

| | | | | |
|---|---|---|---|---|
| CN | 203524585 | U | | 4/2014 |
| CN | 204644936 | U | * | 9/2015 |
| CN | 204644936 | U | | 9/2015 |
| CN | 105433860 | A | | 3/2016 |
| CN | 105433860 | A | * | 3/2016 |
| CN | 105759820 | A | | 7/2016 |
| CN | 205433559 | U | | 8/2016 |
| CN | 105953787 | A | | 9/2016 |
| CN | 206049779 | U | | 3/2017 |
| CN | 206187099 | U | | 5/2017 |
| CN | 107044857 | A | | 8/2017 |
| CN | 206528403 | U | | 9/2017 |
| CN | 107505940 | A | | 12/2017 |
| DE | 102011004319 | A1 | | 8/2012 |
| KR | 101392338 | B1 | | 5/2014 |
| RO | 129857 | | | 11/2014 |

OTHER PUBLICATIONS

Decision of Rejection for Chinese patent application No. 201810032489.9 dated Dec. 1, 2020.

* cited by examiner

INTELLIGENT FLOOR CLEANING ROBOT

FIELD OF THE INVENTION

The present invention relates to the field of cleaning devices, and in particular, to an intelligent floor cleaning robot.

DESCRIPTION OF THE PRIOR ART

In China, most existing floor cleaning vehicles are driven manually to complete works. Such floor cleaning vehicles easily miss to-be-cleaned areas, resulting in relatively low working efficiency and relatively high maintenance costs. In addition, automatic intelligent floor cleaning robots that can clean to-be-cleaned areas automatically without manual operations also emerge on the market, improving the working efficiency. However, the intelligent floor cleaning robots cannot flexibly react to an emergency such as failure of an automatic navigator or a sudden environmental change in a working area.

The conventional floor cleaning vehicle easily misses a to-be-cleaned area when driven manually to clean a site, resulting in relatively low working efficiency and high maintenance costs, while the existing intelligent floor cleaning robot cannot react to an emergent or a temporary environmental change. When a map of an initial working environment is drawn in a laser navigation mode, the existing intelligent floor cleaning robot needs complex manual operations and has relatively low efficiency.

Therefore, a person skilled in the art is dedicated to developing an intelligent floor cleaning robot to change a driving mode of the existing floor cleaning vehicle, so that the floor cleaning vehicle can realize unmanned operations and can also be driven manually. The robot can work in different areas and at different floors by means of a navigation apparatus. During laser navigation, environmental information collection is easier in a manual driving mode. As such, the foregoing technical disadvantages are overcome.

SUMMARY OF THE INVENTION

In view of the foregoing disadvantages in the prior art, a technical problem to be resolved in the present invention is to provide a dual-mode intelligent floor cleaning robot to overcome the technical disadvantages of the existing floor cleaning robot, so as to improve working efficiency. The robot keeps the original manual driving function while ensuring implementation of autonomous working, so as to react to a complex environment or an emergent environmental change by switching from autonomous driving to manual driving. In addition, during laser navigation, a site map is drawn rapidly and efficiently in a manual driving mode, so that environmental information collection becomes simple, efficient, and accurate.

To achieve the foregoing objective, the present invention provides an intelligent floor cleaning robot, including a vehicle body, a clean water tank, a control box, a dirty water tank, a floor cleaning apparatus, a manual steering apparatus, an autonomous steering apparatus, a navigation apparatus, and a mileage apparatus.

The vehicle body includes a steering rack, a steering driving wheel, a driven wheel, and a frame, the steering driving wheel and the driven wheel are located at front and rear sides of a bottom portion of the frame, and the steering driving wheel is connected to the frame by using a rotating shaft.

The clean water tank is located above the vehicle body and is fixedly connected to the vehicle body; and the control box is located in a middle location above the vehicle body and is fixedly connected to the vehicle body.

The dirty water tank is located at a rear side above the clean water tank and is fixedly connected to the clean water tank.

The floor cleaning apparatus is located below the vehicle body.

The navigation apparatus includes a 3D laser and a laser mounting rack, and the navigation apparatus is located above the vehicle body.

Further, the manual steering apparatus includes the rotating shaft, a steering wheel, and a seat; a lower end of the rotating shaft is linked to the steering driving wheel; an upper end of the rotating shaft is connected to the steering wheel; and the seat is located above the control box.

Further, a linkage mode between the lower end of the rotating shaft and the steering driving wheel is chain transmission or gear transmission.

Further, a connection mode between the upper end of the rotating shaft and the steering wheel is coaxial connection, fixed connection, or key connection.

Further, the floor cleaning apparatus is located between the steering driving wheel and the driven wheel, and the floor cleaning apparatus is communicated with the clean water tank and the dirty water tank.

Further, the autonomous steering apparatus includes a transmission apparatus and a drive motor, the autonomous steering apparatus is located in the steering rack and is fixedly connected to the steering rack, and the transmission apparatus is connected to the steering driving wheel by using the rotating shaft.

Further, the mileage apparatus includes a mileage transmission apparatus, an encoder, and an encoder mounting rack; the encoder mounting rack is fixedly connected to the vehicle body; and the encoder is mounted on the encoder mounting rack, and is in engaged transmission with the driven wheel by using the transmission apparatus.

Further, the transmission apparatus may be a timing belt transmission apparatus or a gear transmission apparatus.

Further, the control box includes a drive power supply, an electric control board, and a drive mode toggle switch; the drive power supply and the electrical control board are located in the middle location above the vehicle body and are fixedly connected to the vehicle body; and the drive mode toggle switch is mounted below the steering wheel.

In another preferred implementation of the present invention, the manual steering apparatus further includes a universal joint and a second rotating shaft; the manual steering apparatus is located in the steering rack; the lower end of the rotating shaft is connected to the second rotating shaft by using the universal joint; and the universal joint is in key connection with the rotating shaft and the second rotating shaft.

The intelligent floor cleaning robot provided in the present invention can change a driving mode of an existing floor cleaning vehicle, so that driverless driving or manual driving of the floor cleaning vehicle can be implemented. The robot can work in different areas and at different floors by means of the navigation apparatus, thereby improving working efficiency and reducing maintenance costs. During laser navigation, environmental information collection is easier, faster, simpler, and more efficient in a manual driving mode.

The following further describes the idea, specific structure, and generated technical effects of the present invention with reference to the accompany drawings, so that the objective, features, and effects of the present invention can be fully understood.

1: Vehicle body; 11: Steering rack; 12: Steering driving wheel; 13: Driven wheel; 14: Frame; 2: Clean water tank; 3: Control box; 31: Drive power supply; 32: Electric control board; 33: Drive mode; 4: Dirty water tank; 5: Floor cleaning apparatus; 6: Manual steering apparatus; 61: Rotating shaft; 62: Steering wheel; 63: Seat; 7: Autonomous steering apparatus; 71: Transmission apparatus; 72: Drive motor; 8: Navigation apparatus; 81: 3D laser; 82: Laser mounting rack; 9: Mileage apparatus; 91: Mileage transmission apparatus; 92: Encoder; and 93: Encoder mounting rack.

DETAILED DESCRIPTION OF THE PREFERRED EMBODIMENTS

The following describes a plurality of preferred embodiments of the present invention with reference to the accompanying drawings of the specification, to make technical content of the present invention clearer and more comprehensible. The present invention may be embodied by embodiments of various forms, and the protection scope of the present invention is not limited to the embodiments mentioned in the disclosure.

In the accompany drawings, components having same structures are represented by same numerals, and components having similar structures or functions are represented by similar numerals. The size and the thickness of each component shown in the accompanying drawings are arbitrarily shown. The present invention does not limit the size and the thickness of each component. To make the figure clearer, thicknesses of components in some portions are exaggerated in the accompany drawings.

Embodiment 1

Figure 1:
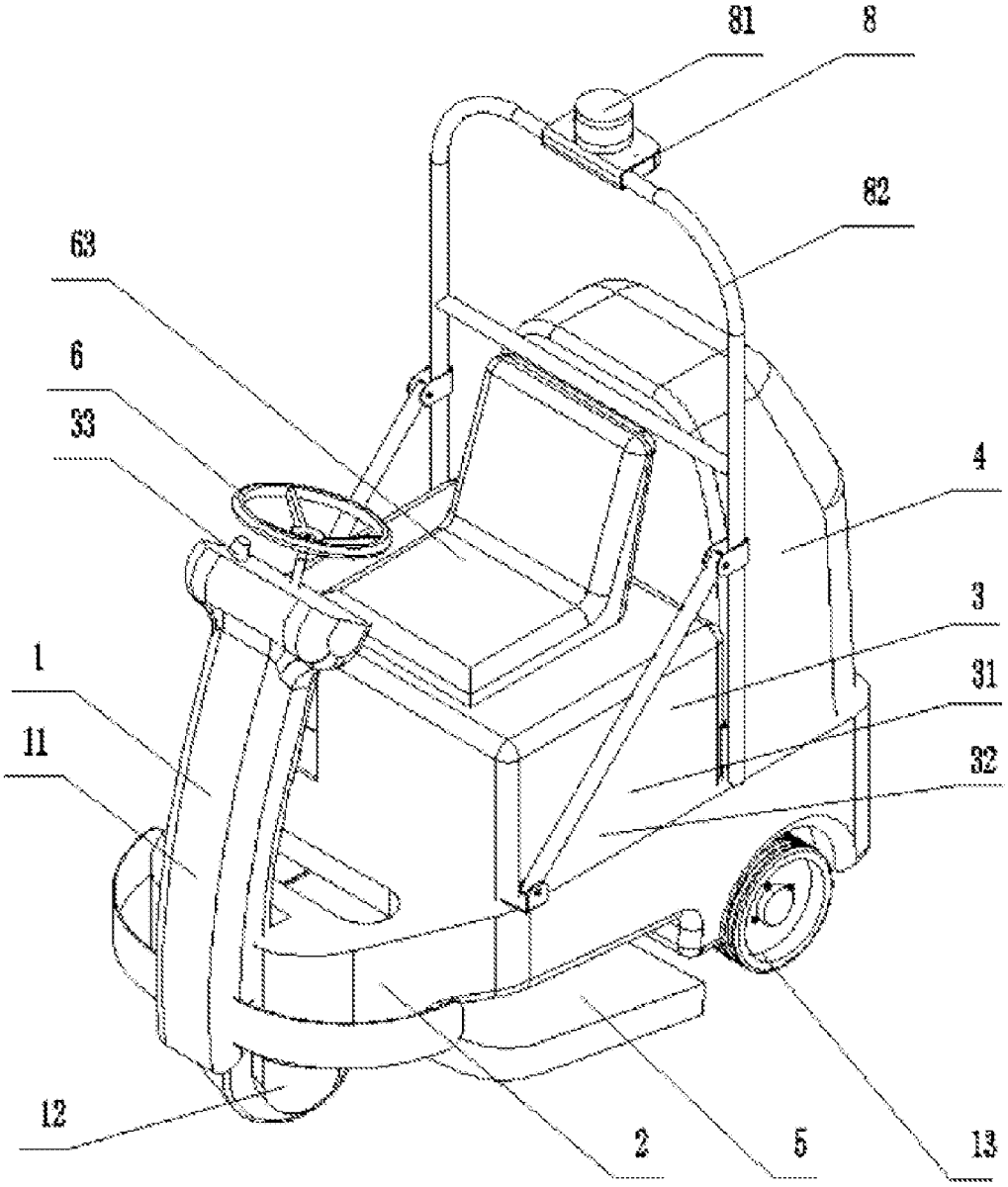
FIG. 1 is a three-dimensional structural diagram of an intelligent floor cleaning robot according to Embodiment 1 and Embodiment 2 of the present invention.
Figure 2:
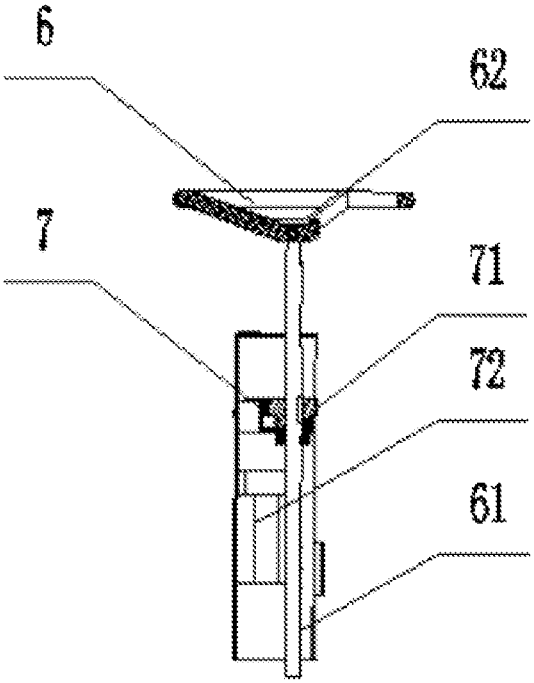
FIG. 2 is a sectional view of an autonomous steering apparatus and a manual driving apparatus according to Embodiment 1 of the present invention.

An intelligent floor cleaning robot shown in FIG. 1 and FIG. 2 includes a vehicle body 1, a clean water tank 2, a control box 3, a dirty water tank 4, a floor cleaning apparatus 5, a manual steering apparatus 6, an autonomous steering apparatus 7, a navigation apparatus 8, and a mileage apparatus 9.

The vehicle body 1 includes a steering rack 11, a steering driving wheel 12, a driven wheel 13, and a frame 14. The steering driving wheel 12 and the driven wheel 13 are located at front and rear sides of a bottom portion of the frame 14. The steering driving wheel 12 at the front portion of the frame 14 may rotate by using a rotating shaft 61, and a driving direction is changed by the rotation.

The clean water tank 2 is located above the vehicle body 1 and is fixedly connected to the vehicle body.

The control box 3 includes a drive power supply 31, an electric control board 32, and a drive mode toggle switch 33. The drive power supply 31 and the electric control board 32 are located in a middle location above the vehicle body 1 and are fixedly connected to the vehicle body. The drive mode toggle switch 33 is mounted below a steering wheel 62, so that a person can easily switch a driving control mode.

The dirty water tank 4 is located at a rear side above the clean water tank 2 and is fixedly connected to the clean water tank 2.

The floor cleaning apparatus 5 is located below the vehicle body 1, and is disposed between the steering driving wheel 12 and the driven wheel 13, so as to achieve the effect of cleaning the floor while saving space. The floor cleaning apparatus is communicated with the clean water tank 2 and the dirty water tank 4. The clean water tank 2 may provide clean water for cleaning. After the floor cleaning apparatus 5 cleans the floor, dirty water is collected and transmitted to the dirty water tank 4.

The manual steering apparatus 6 includes the rotating shaft 61, the steering wheel 62, and a seat 63. A lower end of the rotating shaft 61 is linked to the steering driving wheel 12, and a linkage mode may be chain transmission or gear transmission. An upper end of the rotating shaft 61 is in coaxial connection, fixed connection, or key connection with the steering wheel 62. The seat 63 is located above the control box 3. In a manual driving control mode, a worker rotates the steering wheel 62 to drive the rotating shaft 61 to rotate, and the rotating shaft drives the steering driving wheel 12 to rotate, so as to change the driving direction.

The autonomous steering apparatus 7 includes a transmission apparatus 71 and a drive motor 72. The drive motor 72 is located in the steering rack 11 and is fixedly connected to the steering rack. The transmission apparatus 71 is connected to the rotating shaft 61 and the drive motor 72. After the drive mode toggle switch 33 is pressed, the driving mode is changed from manual steering to autonomous driving. The whole vehicle is driven by means of the navigation apparatus 8 under control of the control box 3. When the direction needs to be changed, the drive motor 72 starts to work and drives, by using the transmission apparatus 71, the rotating shaft 61 to rotate, and the rotating shaft drives the steering driving wheel 12 to rotate, so as to change the travelling direction.

The navigation apparatus 8 includes a 3D laser 81 and a laser mounting rack 82. The navigation apparatus is located above the entire vehicle.

Figure 4:
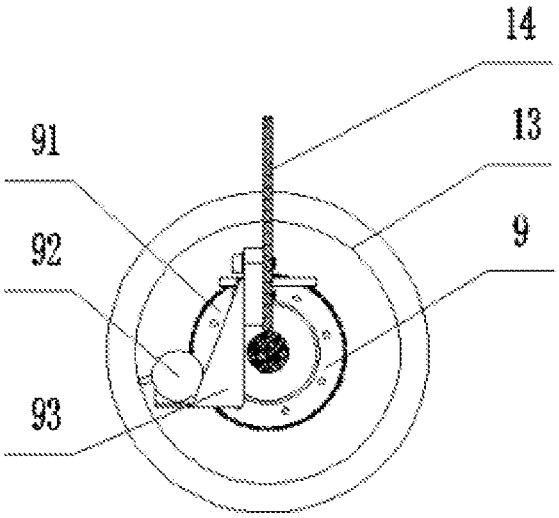
FIG. 4 is a schematic diagram of a mileage apparatus of the intelligent floor cleaning robot according to Embodiment 1 and Embodiment 2 of the present invention, where

As shown in FIG. 4, the mileage apparatus 9 includes a mileage transmission apparatus 91, an encoder 92, and an encoder mounting rack 93. The encoder mounting rack 93 is fixedly connected to the vehicle body 1. The encoder 92 is mounted on the encoder mounting rack 93 and is in engaged transmission with the driven wheel 13 by using the mileage transmission apparatus 91. A transmission mode may be timing belt transmission or gear transmission.

Embodiment 2

Figure 3:
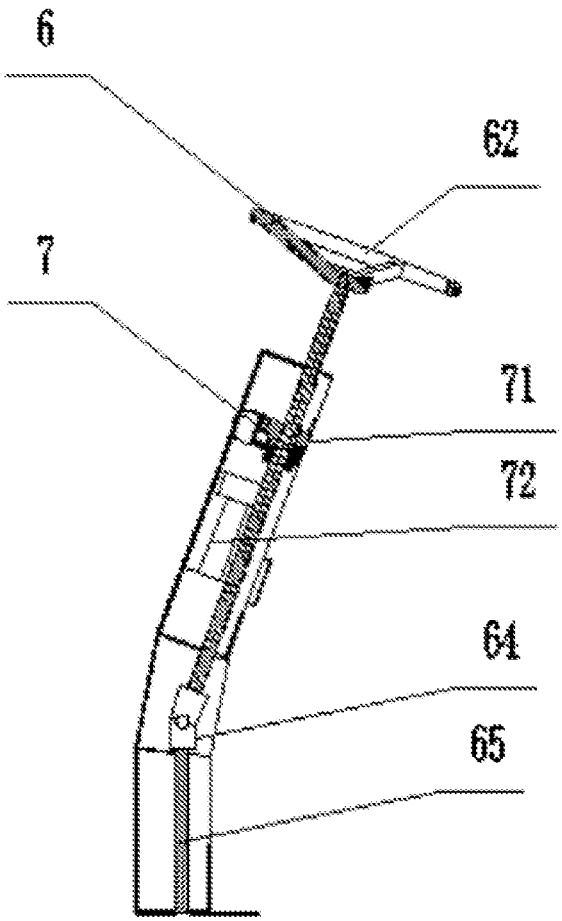
FIG. 3 is a sectional view of an autonomous steering apparatus and a manual driving apparatus according to Embodiment 2 of the present invention.

An intelligent floor cleaning robot shown in FIG. 1 and FIG. 3 includes a vehicle body 1, a clean water tank 2, a control box 3, a dirty water tank 4, a floor cleaning apparatus 5, a manual steering apparatus 6, an autonomous steering apparatus 7, a navigation apparatus 8, and a mileage apparatus 9.

The vehicle body 1 includes a steering rack 11, a steering driving wheel 12, a driven wheel 13, and a frame 14. The steering driving wheel 12 and the driven wheel 13 are located at front and rear sides of a bottom portion of the frame 14. The steering driving wheel 12 at the front portion of the frame 14 may rotate by using a rotating shaft 61, and a travelling direction is changed by the rotation.

The clean water tank 2 is located above the vehicle body 1 and is fixedly connected to the vehicle body.

The control box 3 includes a drive power supply 31, an electric control board 32, and a drive mode toggle switch 33. The drive power supply 31 and the electric control board 32 are located in a middle location above the vehicle body 1 and are fixedly connected to the vehicle body. The drive mode toggle switch 33 is mounted below a steering wheel 62, so that a person can easily switch a driving control mode.

The dirty water tank 4 is located at a rear side above the clean water tank 2 and is fixedly connected to the clean water tank 2.

The floor cleaning apparatus 5 is located below the vehicle body 1, and is disposed between the steering driving wheel 12 and the driven wheel 13, so as to achieve the effect of cleaning the floor while saving space. The floor cleaning apparatus is communicated with the clean water tank 2 and the dirty water tank 4. The clean water tank 2 may provide clean water for cleaning. After the floor cleaning apparatus 5 cleans the floor, dirty water is collected and transmitted to the dirty water tank 4.

The manual steering apparatus 6 includes the rotating shaft 61, the steering wheel 62, a seat 63, a universal joint 64, and a second rotating shaft 65. The manual steering apparatus 6 is located in the steering rack 11. A lower end of the rotating shaft 61 is connected to the second rotating shaft 65 by using the universal joint 64. The universal joint is in key connection with the rotating shaft and the second rotating shaft. A lower end of the second rotating shaft 65 is linked to the steering driving wheel 12. A linkage mode may be chain transmission or gear transmission. An upper end of the rotating shaft 61 is in coaxial connection, fixed connection, or key connection with the steering wheel 62. The seat 63 is located above the control box 3. In a manual driving control mode, a worker rotates the steering wheel 62 to drive the rotating shaft 61 to rotate. The rotating shaft drives, by using the universal joint 64, the second rotating shaft 65 to rotate. The second rotating shaft 65 drives the steering driving wheel 12 to rotate, so as to change the travelling direction.

The autonomous steering apparatus 7 includes a transmission apparatus 71 and a drive motor 72. The drive motor 72 is located in the steering rack 11 and is fixedly connected to the steering rack. The transmission apparatus 71 is connected to the rotating shaft 61 and the drive motor 72. After the drive mode toggle switch 33 is pressed, the driving mode is changed from manual steering to autonomous driving. The whole vehicle is driven by means of the navigation apparatus 8 under control of the control box 3. When the direction needs to be changed, the drive motor 72 starts to work and drives, by using the transmission apparatus 71, the rotating shaft 61 to rotate. The rotating shaft drives, by using the universal joint 64, the second rotating shaft 65 to drive. The second rotating shaft 65 drives the steering driving wheel 12 to rotate, so as to change the travelling direction.

The navigation apparatus 8 includes a 3D laser 81 and a laser mounting rack 82. The navigation apparatus is located above the entire vehicle.

As shown in FIG. 4, the mileage apparatus 9 includes a mileage transmission apparatus 91, an encoder 92, and an encoder mounting rack 93. The encoder mounting rack 93 is fixedly connected to the vehicle body 1. The encoder 92 is mounted on the encoder mounting rack 93 and is in engaged transmission with the driven wheel 13 by using the mileage transmission apparatus 91. A transmission mode may be timing belt transmission or gear transmission.

Specific preferable embodiments of the present invention are described above in detail. It should be understood that a person of ordinary skill in the art can make various modifications and changes according to the idea of the present invention without creative effort. Therefore, any technical solution that can be obtained according to the idea of the present invention by means of logic analysis, reasoning, or limited experiments should be included in the protection scope determined by the claims.

The invention claimed is:

1. An intelligent floor cleaner, comprising a vehicle body, a clean water tank, a control box, a dirty water tank, a floor cleaning apparatus, a manual steering apparatus, an autonomous steering apparatus, a navigation apparatus, and a mileage apparatus, wherein the vehicle body comprises a steering rack, a steering driving wheel, a driven wheel, and a frame, the steering driving wheel and the driven wheel are located at front and rear sides of a bottom portion of the frame, and the steering driving wheel is connected to the frame by using a rotating shaft;

the clean water tank is located above the vehicle body and is fixedly connected to the vehicle body; the control box is located in a middle location above the vehicle body and is fixedly connected to the vehicle body;

the dirty water tank is located at a rear side above the clean water tank and is fixedly connected to the clean water tank;

the floor cleaning apparatus is located below the vehicle body; and the navigation apparatus comprises a 3D laser and a laser mounting rack, and the navigation apparatus is located above the vehicle body;

wherein the manual steering apparatus comprises the rotating shaft, a steering wheel, a universal joint and a second rotating shaft; the manual steering apparatus being located in the steering rack;

wherein a lower end of the rotating shaft is connected to the second rotating shaft by using the universal joint and an upper end of the rotating shaft is connected to the steering wheel; the second rotating shaft is connected to the steering driving wheel, wherein the rotating shaft and the second rotating shaft have different angles with an action of the universal joint.

2. The intelligent floor cleaner according to claim 1, wherein the manual steering apparatus further comprises a seat which is located above the control box.

3. The intelligent floor cleaner according to claim 2, wherein a linkage mode between the lower end of the rotating shaft and the steering driving wheel is chain transmission or gear transmission.

4. The intelligent floor cleaner according to claim 2, wherein a connection mode between the upper end of the rotating shaft and the steering wheel is coaxial connection, fixed connection, or key connection.

5. The intelligent floor cleaner according to claim 2, wherein the control box comprises a drive power supply, an electric control board, and a drive mode toggle switch; the drive power supply and the electrical control board are located in the middle location above the vehicle body and are fixedly connected to the vehicle body; and the drive mode toggle switch is mounted below the steering wheel.

6. The intelligent floor cleaner according to claim 2, wherein the universal joint is in key connection with the rotating shaft and the second rotating shaft.

7. The intelligent floor cleaner according to claim 1, wherein the autonomous steering apparatus comprises a transmission apparatus and a drive motor, the autonomous steering apparatus is located in the steering rack and is fixedly connected to the steering rack, and the transmission apparatus is connected to the steering driving wheel by using the rotating shaft.

8. The intelligent floor cleaner according to claim 1, wherein the floor cleaning apparatus is located between the steering driving wheel and the driven wheel, and the floor cleaning apparatus is communicated with the clean water tank and the dirty water tank.

9. The intelligent floor cleaner according to claim 1, wherein the mileage apparatus comprises a mileage transmission apparatus, an encoder, and an encoder mounting rack; the encoder mounting rack is fixedly connected to the vehicle body; and the encoder is mounted on the encoder mounting rack and is in engaged transmission with the driven wheel by using the transmission apparatus.

10. The intelligent floor cleaner according to claim 9, the transmission apparatus is a timing belt transmission apparatus or a gear transmission apparatus.

* * * * *